US008944271B2

(12) United States Patent
Seguin

(10) Patent No.: US 8,944,271 B2
(45) Date of Patent: Feb. 3, 2015

(54) TUBE HEAD EQUIPPED WITH A LID, ASSOCIATED WITH AN IMPROVED PERFORATING CAP WHICH ENSURES PROTECTION OF THE LID PRIOR TO FIRST USE THEREOF

(71) Applicant: Albea Services, Gennevilliers (FR)

(72) Inventor: Franck Seguin, Paris (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 14/140,530

(22) Filed: Dec. 25, 2013

(65) Prior Publication Data

US 2014/0175099 A1 Jun. 26, 2014

(30) Foreign Application Priority Data

Dec. 26, 2012 (FR) ..... 12 62805

(51) Int. Cl.
*B65D 51/22* (2006.01)
*B65D 35/44* (2006.01)
*B65D 41/20* (2006.01)

(52) U.S. Cl.
CPC ..... *B65D 51/225* (2013.01); *B65D 35/44* (2013.01); *B65D 41/20* (2013.01); *B65D 2251/0028* (2013.01); *B65D 2251/0096* (2013.01)
USPC ..... 220/278; 206/222; 220/258.4

(58) Field of Classification Search
CPC ..... B65D 35/44; B65D 41/20; B65D 51/22; B65D 51/225; B65D 55/089
USPC ..... 206/222; 220/278, 258.4
See application file for complete search history.

(56) References Cited

U.S. PATENT DOCUMENTS

| | | | | |
|---|---|---|---|---|
| 3,182,858 | A * | 5/1965 | Beaudoin | 222/83 |
| 4,307,821 | A * | 12/1981 | McIntosh | 222/83 |
| 4,760,941 | A * | 8/1988 | Salmon et al. | 222/153.07 |
| 6,886,716 | B2 * | 5/2005 | Weiler | 222/83 |
| 7,591,398 | B2 * | 9/2009 | Pritikin et al. | 222/80 |
| 7,870,952 | B2 * | 1/2011 | Fontana | 206/222 |
| 2014/0190973 | A1 * | 7/2014 | Kerman | 220/278 |

FOREIGN PATENT DOCUMENTS

| | | |
|---|---|---|
| CH | 576376 | 6/1976 |
| DE | 202004004539 | 5/2004 |

* cited by examiner

*Primary Examiner* — Anthony Stashick
*Assistant Examiner* — Mollie Llewellyn
(74) *Attorney, Agent, or Firm* — Steven M. Greenberg, Esq.; CRGO Law

(57) ABSTRACT

A tube head assembly includes a tube head that includes a solid insert forming a lid closing the neck, a cap that includes a punch, and a removable spacing ring disposed against the shoulder around the neck. The ring and the cap are formed integrally in one piece and are joined by material bridges and configured in such a way as to allow sliding of the cap through the ring after breakage of the material bridges, characterised in that the ring includes internal stops adapted to limit the movement of the cap through the ring in such a way as to keep the punch spaced from the lid when the cap is screwed onto the neck and butts against the ring.

6 Claims, 6 Drawing Sheets

TUBE HEAD EQUIPPED WITH A LID, ASSOCIATED WITH AN IMPROVED PERFORATING CAP WHICH ENSURES PROTECTION OF THE LID PRIOR TO FIRST USE THEREOF

CROSS REFERENCE TO RELATED APPLICATIONS

This application claims priority under 35 U.S.C. §119(a) to French Patent Application Serial Number 1262805, filed Dec. 26, 2012, entitled "TUBE HEAD EQUIPPED WITH A LID, ASSOCIATED WITH AN IMPROVED PERFORATING CAP WHICH ENSURES PROTECTION OF THE LID PRIOR TO FIRST USE THEREOF", the entire teachings of which are incorporated herein by reference.

BACKGROUND OF THE INVENTION

1. Field of the Invention

The present invention relates to the field of flexible tubes.

2. Description of the Related Art

Tubes are known which are provided with a lid associated with a perforating cap comprising a punch adapted in order to perforate the lid when the cap is inserted in a first direction into the neck of the tube, and in order to be screwed onto the neck when it is positioned in a second direction on the neck of the tube.

In fact the lid makes it possible to keep the product contained in the tube sealed during its storage prior to its first use, which represents a very significant part of the overall service life of the tube.

However, such solutions are not very practical and not greatly appreciated by users. They also lead to having a tube with a punch which projects from its cap during its use and its storage, and a pushing force is required in order to pierce the lid with the aid of the punch of the cap.

In order to remedy these drawbacks, solutions have been proposed in which the punch is disposed in the cap in such a way as to be able to perforate the lid when the cap is screwed onto the tube head. However, in order to ensure the preservation of the lid prior to the first use, a spacing ring is disposed between the cap and the shoulder of the head of the tube, so as to keep the punch spaced apart from the lid when the cap is screwed onto the neck.

However, such solutions are very restrictive industrially in that they necessitate the positioning of a plurality of parts on the tube head, the ring and the cap being commonly formed from two separate parts.

It has likewise been proposed to produce the cap and the ring integrally formed in one piece, these two elements thus being linked by material bridges adapted to be broken by screwing or unscrewing of the cap. However, the positioning of the cap on the tube head by machine then requires extreme precision in order not to break the material bridges systematically during capping, making this solution impracticable.

BRIEF SUMMARY OF THE INVENTION

The present invention seeks to propose an assembly comprising a tube head comprising a lid and a cap provided with a punch adapted in order to ensure the preservation of the lid prior to the first use, whilst being exploitable on an industrial scale for the operations of manufacture and positioning of the cap on the tube head.

To this end, the invention proposes an assembly comprising

- a tube head that includes a neck defining a longitudinal axis, a shoulder and a solid insert forming a lid closing the neck,
- a cap that includes a punch adapted in order to cut the lid, the cap being adapted to be screwed onto the neck, and configured in such a way that when the cap is screwed onto the neck the punch is inserted into the interior of the neck,
- a removable spacing ring disposed bearing against the shoulder around the neck, The ring and the cap are formed integrally in one piece and joined by material bridges. The ring further has an internal diameter greater than the external diameter of the cap, so as to enable the cap to slide through the ring after breakage of the material bridges, characterised in that the ring includes internal stops adapted to limit the movement of the cap through the ring, in such a way as to keep the punch spaced apart from the lid when the cap is screwed onto the neck and butted against the ring.

The assembly typically has one or more of the following optional characteristics, considered independently or in combination;

- the punch is adapted in order, after the withdrawal of the spacing ring from the assembly, when the cap is screwed in abutment against the shoulder, to achieve partial cutting of the lid in order to open the neck, the lid then being attached to the uncut part of the insert by a material bridge.
- the spacing ring includes ribs adapted to centre the spacing ring around the neck.
- the spacing ring has the shape of a portion of a circle of which a free end forms a tab which can be gripped by a user.
- the punch has a free end bevelled along a plane inclined with respect to the longitudinal axis of the neck when the cap is screwed onto the neck. The free end is then typically bevelled and has a semi-circular cross-section.

Thus the invention ensures a limitation of the movement of the cap after it has been positioned on the tube head and after the breakage of the material bridges linking it to the ring resulting from the action of an industrial capper, thus protecting the lid from any perforation or cutting prior to the first use of the assembly by a user.

BRIEF DESCRIPTION OF THE SEVERAL VIEWS OF THE DRAWINGS

Other characteristics, objects and advantages of the invention will become apparent from the description which follows, which is purely illustrative and non-limiting, and which should be read in relation to the appended drawings, in which.

In the set of drawings, the elements in common are referenced by identical reference numerals.

DETAILED DESCRIPTION OF THE INVENTION

Figure 1:
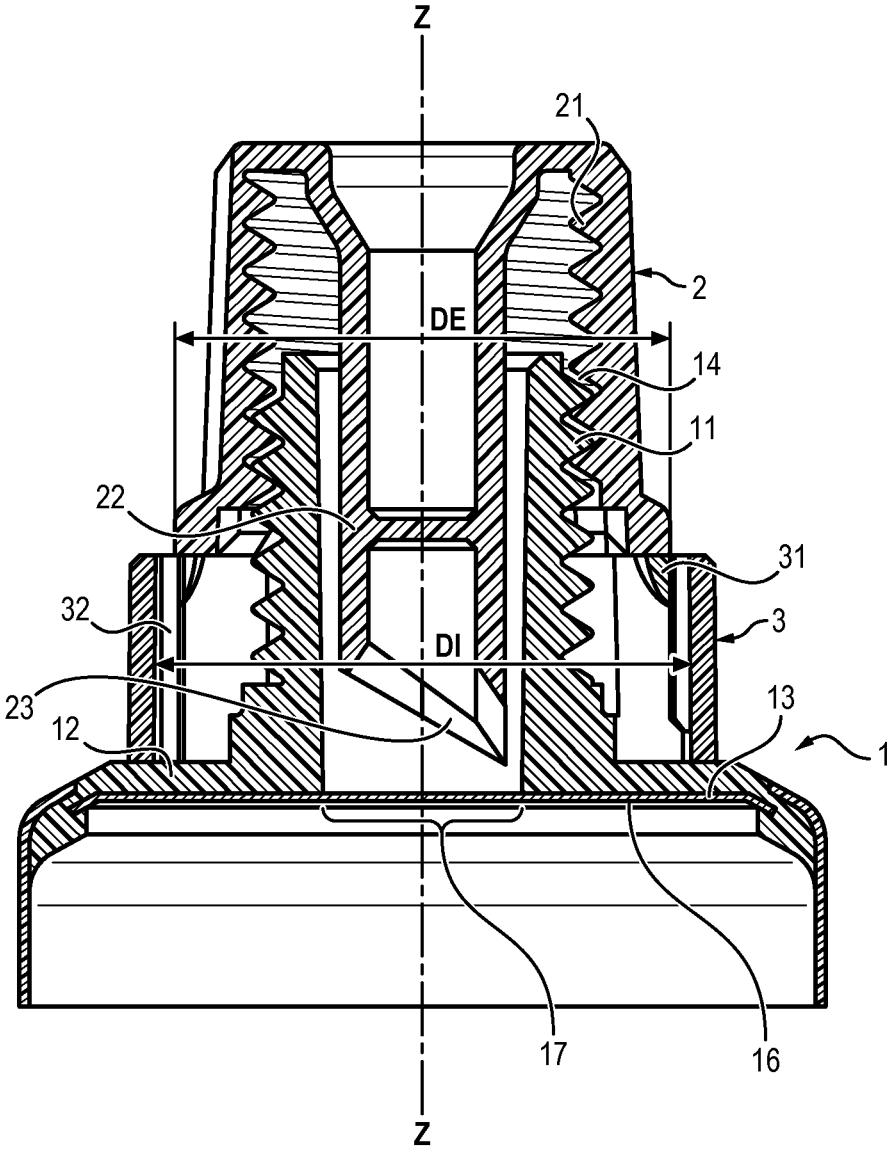
FIG. 1 shows a sectional view of an assembly according to one aspect of the invention.

FIG. 1 shows an example of an assembly according to one aspect of the invention. As shown in FIG. 1, a tube head assembly can include the following:

a tube head 1, a cap 2, and a removable spacing ring 3.

Figure 3:
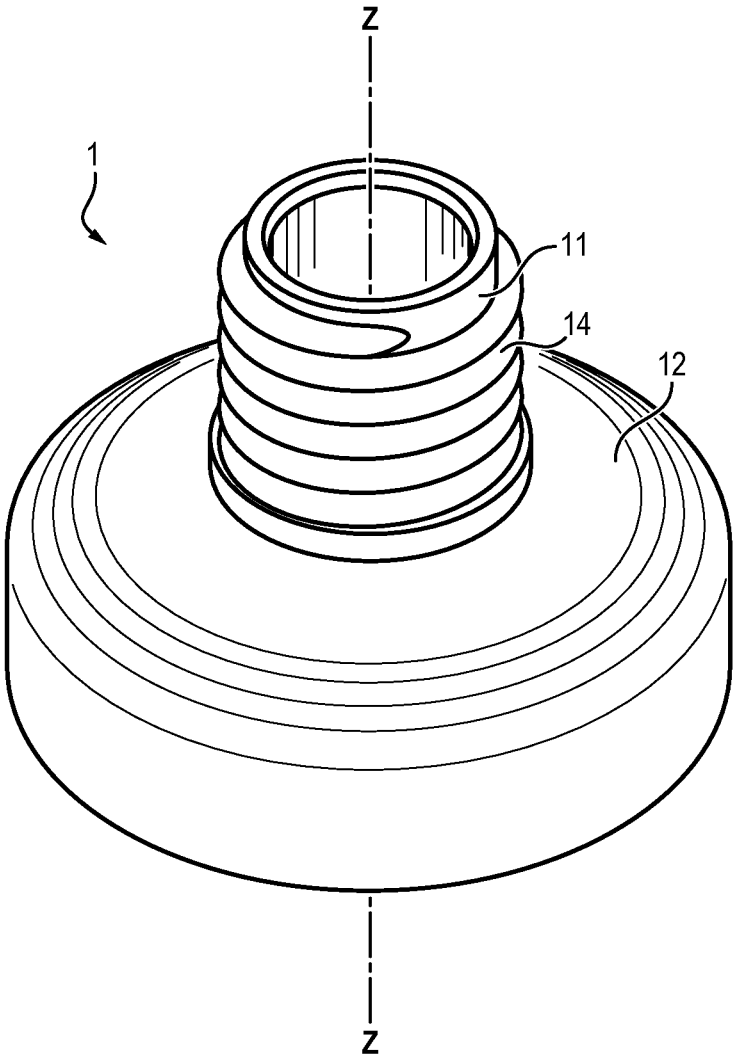
FIGS. 3 and 4 show two embodiments of a tube head of an assembly according to one aspect of the invention.
Figure 4:
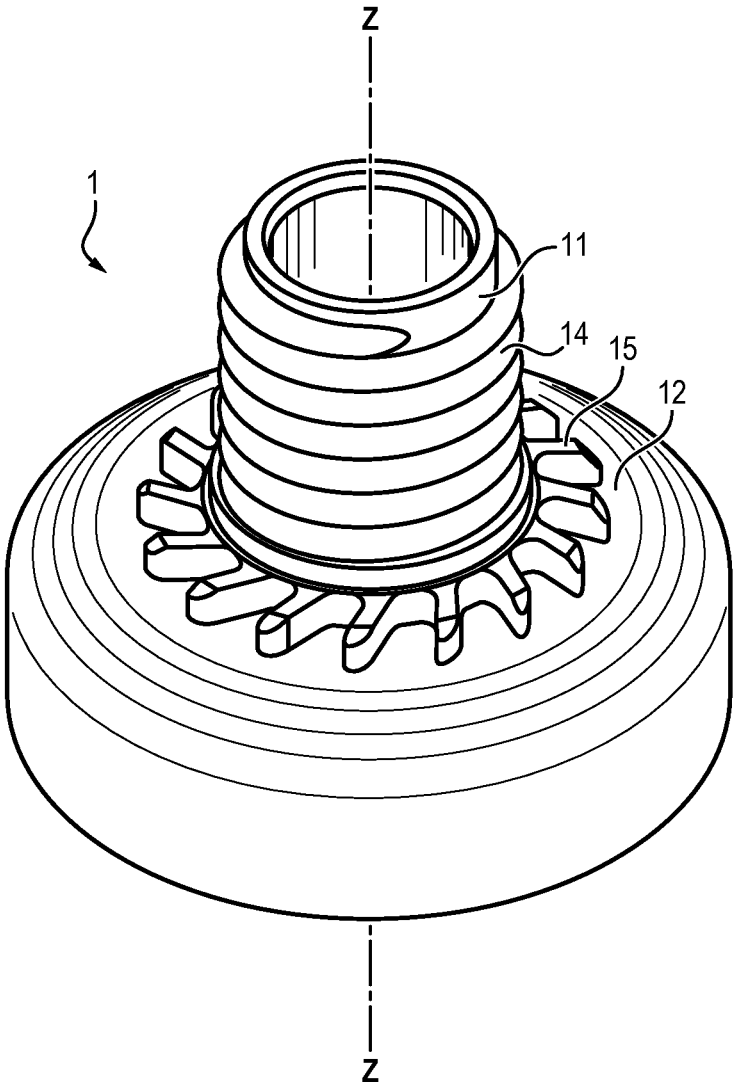

The tube head 1, of which two variants are also shown in FIGS. 3 and 4, comprises a neck 11 defining a longitudinal axis Z-Z, a shoulder 12 and a solid insert 13 forming a lid closing the neck 11.

More precisely, the insert 13 includes a peripheral section 16, typically in the shape of a truncated cone or a disc, and a central section 17 forming the lid, of which the diameter corresponds typically to the internal diameter of the neck 11.

The neck 11 includes a thread 14 on its external periphery, adapted to enable the cap 2 to be screwed onto the neck 11.

The cap 2 includes an internal tapping 21 adapted in order to co-operate with the thread 14 of the neck 11, and a punch 22 configured in such a way as to be inserted in the interior of the neck 11 of the tube head 1 when the cap 2 is screwed onto the neck 11. A longitudinal direction of the cap 2 is defined, corresponding to the longitudinal axis Z-Z of the neck 11 when the cap 2 is screwed onto the neck 11.

Figure 2:
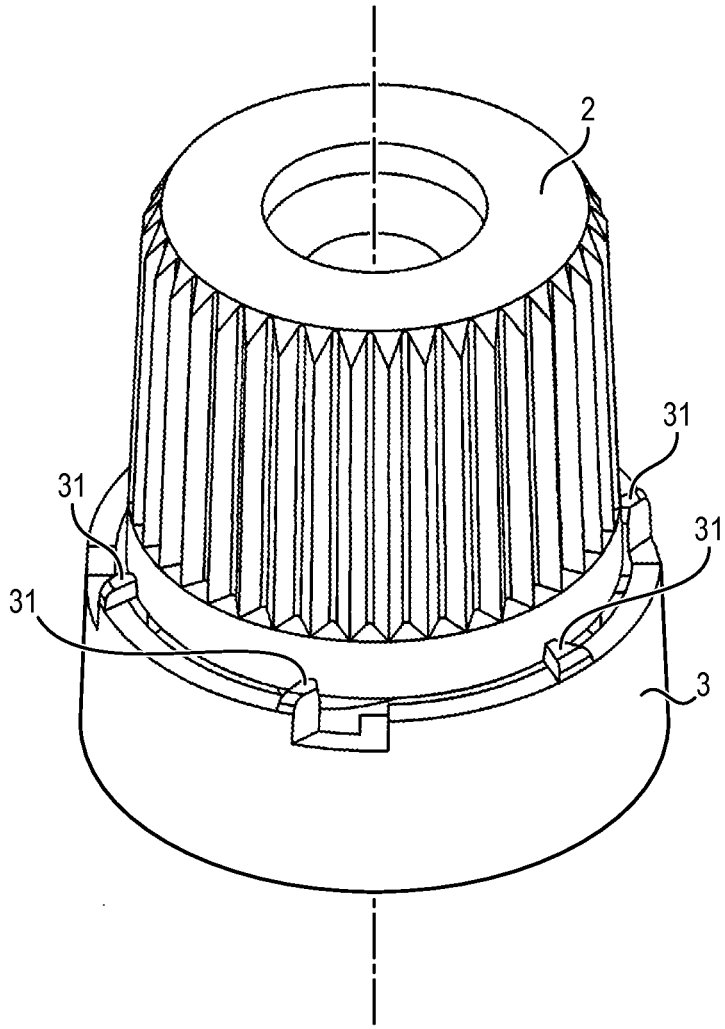
FIG. 2 shows a view of a cap and a spacing ring of an assembly according to one aspect of the invention.

The spacing ring 3 and the cap 2 are integrally formed in one single piece, and thus are connected by material bridges 31 shown in FIG. 2.

The spacing ring 3 is configured so as to be able to be able to be disposed around the neck 11, bearing against the shoulder 12, and thus to maintain a spacing between the cap 2 and the shoulder 12 when the cap 2 is screwed onto the neck 11 and the material bridges 31 joining the spacing ring 3 and the cap 2 have not been broken.

More precisely, the spacing ring 3 is configured so as to keep the punch 22 spaced apart from the insert 13 when the cap 2 is screwed onto the neck 11 and so that the material bridges 31 linking the spacing ring 3 and the cap 2 are not broken, thus preventing the punch from coming into contact with the insert 13 and therefore preventing it from piercing or cutting the lid formed in the neck 11.

FIG. 1 shows this configuration in which the spacing ring 3 is joined to the cap 2 by the material bridges 31 and is disposed around the neck 11, bearing against the shoulder 12 whilst the cap 2 is screwed onto the neck 11. The punch 22 then extends inside the neck 11, at a distance not equal to zero from the insert 13, thus protecting the lid from any cutting or perforation.

In this way, the assembly formed by the cap 2 and the spacing ring 3 can be screwed onto the neck 11, until the spacing ring 3 butts against the shoulder 12, the insert 13 being protected from any punching or cutting as detailed previously.

Moreover, the ring 3 and the cap 2 are produced in such a way that the ring 3 has an internal diameter DI greater than the external diameter DE of the cap 2, in such a way as to allow sliding of the cap 2 through the ring 3 after breakage of the material bridges 31.

On an industrial scale, the capping, that is to say the step during which the cap 2 is screwed onto the neck 11, is typically performed by means of a capper. However, it is very delicate to configure such a machine in order for it to screw the cap 2 onto the neck 11 as far as the precise point where the spacing ring 3 butts against the shoulder 11 whilst protecting the material bridges 31. Indeed, if the rotation of the cap 2 in order to screw it onto the neck 11 is slightly too great, the material bridges 31 break, and the cap 2 is detached from the spacing ring 3, which can cause the perforation of the insert 13.

In order for the spacing ring 3 to ensure the protection of the lid even after breakage of the material bridges 31 joining it to the cap 2 and without extremely precise calibration of the capper, the spacing ring 3 includes internal stops 33 adapted to limit the movement of the cap 2 through the spacing ring 3 once the material bridges 31 are broken, in such a way as to keep the punch 22 spaced from the lid when the cap 2 is screwed onto the neck 11 and butts against the internal stops 33 of the ring 3.

Figure 5:
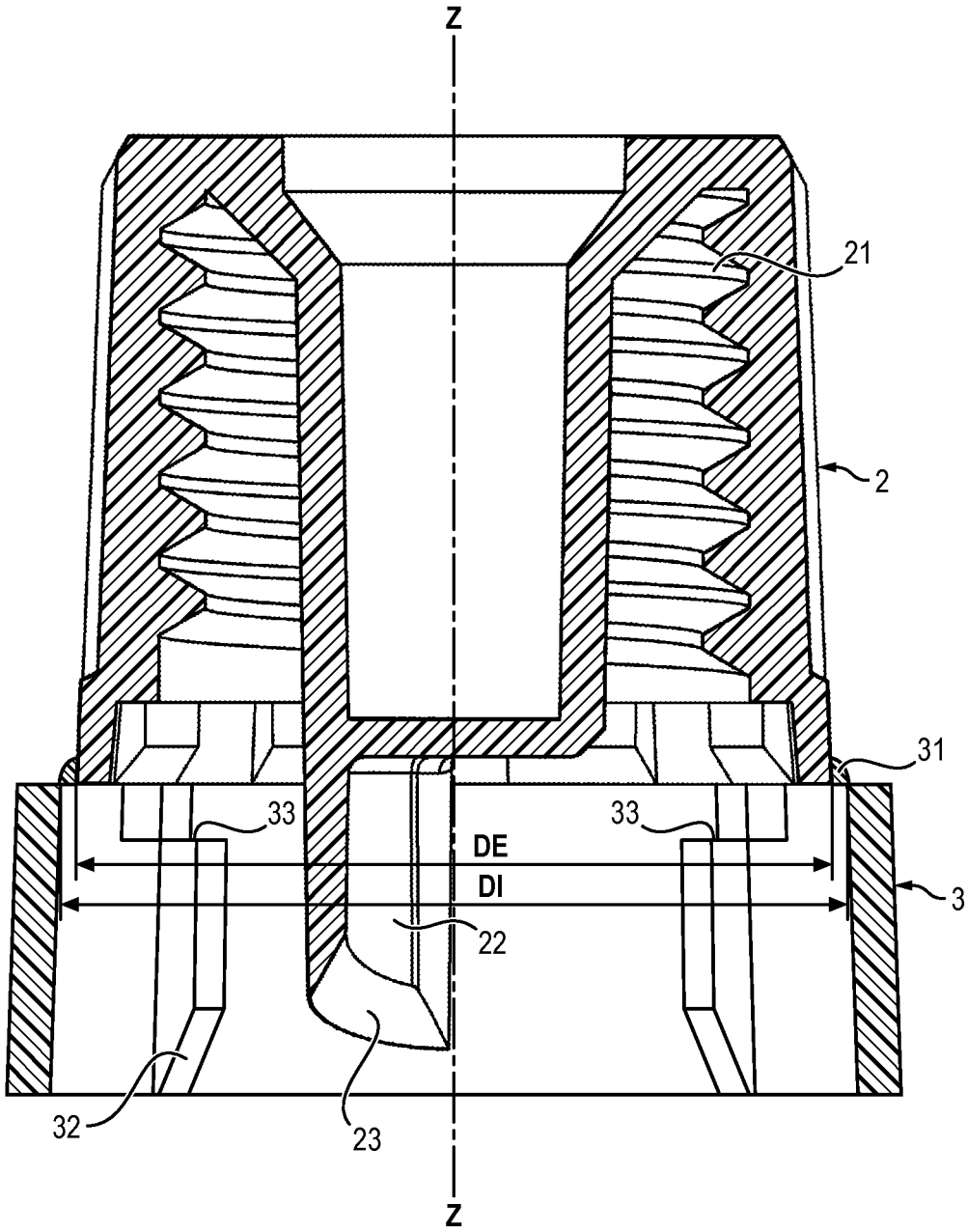
FIGS. 5 and 6 show views of a cap and a spacing ring of an assembly according to one aspect of the invention.
Figure 6:
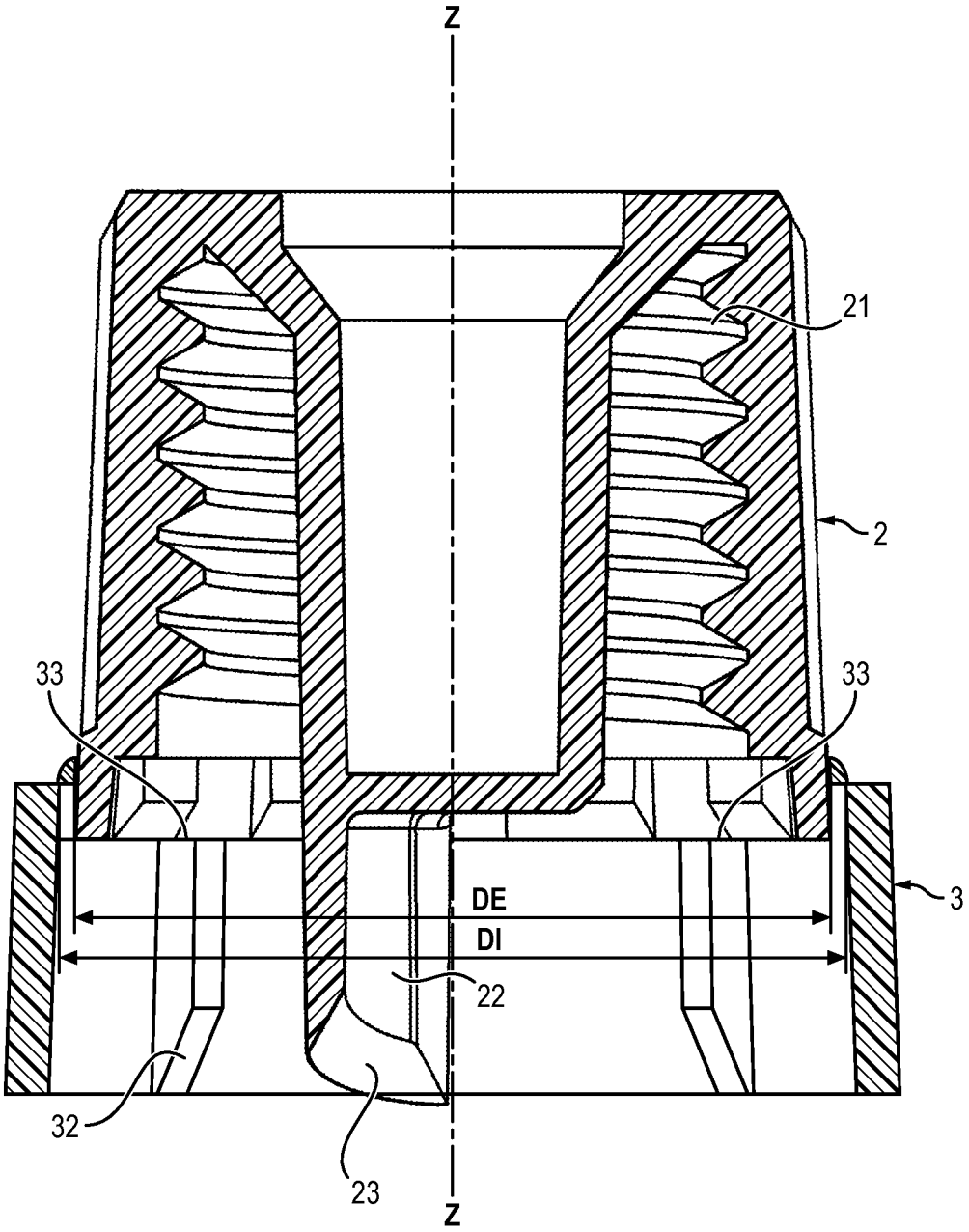

FIGS. 5 and 6 show the action of these internal stops 33 during the breakage of the material bridges 31 in order to limit the movement of the cap 2 through the spacing ring 3.

Thus the internal stops 33 are typically dimensioned in such a way as to define a reduced internal diameter DR of the spacing ring 3, less than the external diameter of the cap 2.

FIG. 5 shows the cap 2 and the spacing ring 3 linked by the material bridges 31 prior to their breakage. The internal stops 33 are formed here by longitudinal internal ribs.

FIG. 6 meanwhile shows the cap 2 and the spacing ring 3 following the breakage of the material bridges 31. The cap 2 has slid in the spacing ring 3, as far as the internal stops 33 which limit this sliding, such that the punch 22 is kept spaced from the lid when the cap 2 is screwed onto the neck 11 and bearing against the internal stops 33 of the spacing ring 3, the spacing ring 3 bearing against the shoulder 12 of the tube head 1.

This limitation of the sliding of the cap 2 in the spacing ring 3 ensures that the punch is kept spaced from the lid, and thus the lid is protected from any cutting or perforation, even in the case of breakage of the material bridges 31, regardless of whether this breakage is intentional or not.

Thus a capper can be calibrated so as to produce the breakage of the material bridges 31 during the capping, so that the user can merely unscrew the cap 2, remove the ring 3, then screw the cap 2 onto the neck in such a way as to perforate or cut the lid, and thus enable dispensing of the product contained in the tube.

Thus the internal stops 33 define a limited travel of the cap 2 through the spacing ring 3 after the breakage of the material bridges 31, typically equal to 1 mm. Such a limited travel enables the use of an industrial capper in order to screw the assembly composed of the cap 2 and the spacing ring 3 on the neck 11, whilst protecting the lid from any perforation or cutting in the event of breakage of the material bridges resulting from the calibration of the capper.

During the first use, the user unscrews the cap 2 from the neck 11, then removes the spacing ring 3 previously detached from the cap 2 by the breakage of the material bridges 31, and re-screws the cap 2 onto the neck 11 until it butts against the neck 11 or against the shoulder 12. The punch 22 has then effected cutting or perforation of the insert 13, and more precisely of the central part 17 thereof forming the lid of the tube head.

The cutting of the lid is advantageously partial, in such a way that the portion or the portions of the lid which has or have been cut remain joined to the rest of the insert 13, thus preventing any mixing of the material forming the insert 13 with a product contained in the associated tube, and a possible dispensing of this material to the user.

By way of example, considering that complete cutting is cutting at 360° of the lid, that is to say circular cutting performed by rotation of the cap 2, a cut of between 250° and 330° is advantageously made, thus forming a sufficient link in order to ensure the cohesion between the central section 17 which has been cut, and the peripheral section 16.

FIGS. 1, 5 and 6 show multiple examples of the shape of the punch 22.

In the embodiment shown in FIG. 1, the punch 22 has a round cylindrical cross-section, of which a free end 23 is bevelled, in such a way that when the cap 2 is screwed onto the neck 11 of the tube head 1, the free end 23 of the punch 22 is inserted into the neck 11, and it is bevelled with respect to a plane normal to the axis Z-Z of the neck 11, the lid formed by the insert 13 being typically disposed in such a plane normal to the axis Z-Z of the neck 11.

Consequently the free end 23 of the punch 22 has circular cross-section inscribed in a plane inclined relative to the axis Z-Z of the neck 11, which coincides with the longitudinal axis of the cap 2.

In the embodiment shown, a chamfer is also produced at the internal edge of the free end 23 of the punch 22, thus making it possible to reduce the thickness thereof in order to give the free end 23 a cutting function, which facilitates the cutting of the lid by the punch 22.

Another embodiment of the punch 22 of the cap 2 is illustrated in FIGS. 5 and 6, the shape of the free end 23 of the punch 22 is similar to that shown in FIG. 1, but extends solely over a bevelled semicircle as described previously, the other part of the free end 23 being recessed in such a way as to be set back from the bevelled semicircle. Such a shape favours the cutting of the lid by the punch, whilst the preceding embodiment provides cutting of the punch by compression.

In the embodiment shown, the shoulder 12 of the tube head 1 includes optional reliefs 15 projecting radially from the junction between the neck 11 and the shoulder 12. These optional reliefs 15 are therefore typically dimensioned in such a way as to have a diameter less than or equal to the internal diameter of the ring 3. The spacing ring 3 is then equipped with means such as internal ribs 32 adapted to co-operate with the reliefs in order to enable the ring to rotate around the neck 12 along the axis Z-Z only in a single direction corresponding to the direction of screwing of the cap 2 on the neck 11, the reliefs 15 co-operating with the ribs 32 in order to prevent the rotation of the spacing ring 3 around the neck 12 in the direction of unscrewing of the cap 2 from the neck 11 of the tube head 1.

FIG. 4 shows an example of an embodiment comprising optional reliefs 15, having a generally helical shape around the axis Z-Z. Multiple embodiments are possible; the optional reliefs 15 may for example form arcs of circles extending from the centre of the neck 11 in order to form a generally spiral shape, or also a general shape of a toothed wheel.

According to a particular embodiment, the internal ribs 32 which also perform the function of stopping rotation by co-operating with the reliefs 15 of the shoulder 12 may likewise form the internal stops 33 limiting the sliding of the cap 2 through the spacing ring 3.

Thus the assembly described allows to obtain a tube head equipped with a lid which ensures sealed storage of a product prior to its first use and associated with an improved perforating cap which ensures controlled cutting by the user during a simple screwing of the cap, whilst preventing any cutting or premature piercing of the lid and enabling industrial capping.

Also, the partial cutting of the lid makes it possible to prevent it from falling into the internal volume of the tube or being expelled by the neck of the tube head, and therefore more generally to prevent it from mixing with the product and being dispensed to the user.

What is claimed is:

1. A tube head assembly comprising:

a tube head comprising a neck defining a longitudinal axis, a shoulder and a solid insert forming a lid closing the neck, a cap comprising a punch adapted to cut the lid, said cap being adapted to be screwed onto said neck, and configured in such a way that when said cap is screwed onto the neck the punch is inserted into an interior of the neck, a removable spacing ring bearing against the shoulder around the neck, the removable spacing ring and the cap being formed integrally in one piece and joined by material bridges, the removable spacing ring having an internal diameter greater than an external diameter of said cap, so as to enable the cap to slide through the removable spacing ring after breakage of said material bridges, characterized in that the removable spacing ring comprises internal stops adapted to limit movement of said cap through the removable spacing ring in such a way as to keep the punch spaced from the lid when the cap is screwed onto the neck and butted against the removable spacing ring.

2. The assembly according to claim 1, wherein said punch is adapted to achieve partial cutting of said lid in order to open said neck when said cap is screwed in abutment against the shoulder after withdrawal of the spacing removable spacing ring from the tube head assembly, the lid remaining attached to an uncut part of the insert.

3. The assembly according to claim 1, wherein the removable spacing ring comprises a plurality of ribs adapted to center the removable spacing ring around the neck.

4. The assembly according to claim 1, wherein the removable spacing ring has a shape of a portion of a circle of which a free end forms a tab which can be gripped by a user.

5. The assembly according to claim 1, wherein said punch has a free end bevelled along a plane inclined with respect to the longitudinal axis (Z-Z) of the neck when the cap is screwed onto said neck.

6. The assembly according to claim 5, wherein said bevelled free end has a semi-circular cross-section.

* * * * *